US005122039A

United States Patent [19]

Tuckey

[11] Patent Number: 5,122,039

[45] Date of Patent: Jun. 16, 1992

[54] ELECTRIC-MOTOR FUEL PUMP

[75] Inventor: Charles H. Tuckey, Cass City, Mich.

[73] Assignee: Walbro Corporation, Cass City, Mich.

[21] Appl. No.: 529,654

[22] Filed: May 29, 1990

[51] Int. Cl.[5] ..... F04B 39/06; F04B 11/00; F01C 1/10

[52] U.S. Cl. ..... 417/366; 417/541; 417/542; 417/543; 418/166

[58] Field of Search ..... 417/366, 541, 542, 543; 418/166, 171

[56] References Cited

U.S. PATENT DOCUMENTS

| | | | |
|---|---|---|---|
| 4,619,588 | 10/1986 | Moore, III | 417/366 |
| 4,642,030 | 2/1987 | Friebe et al. | 417/366 |
| 4,673,342 | 6/1987 | Saegusa | 418/166 |
| 4,978,282 | 12/1990 | Fu et al. | 417/366 |

FOREIGN PATENT DOCUMENTS

| | | | |
|---|---|---|---|
| 0232395 | 10/1986 | Japan | 418/166 |

*Primary Examiner*—Richard A. Bertsch
*Assistant Examiner*—Alfred Basichas
*Attorney, Agent, or Firm*—Barnes, Kisselle, Raisch, Choate, Whittemore & Hulbert

[57] ABSTRACT

An electric-motor fuel pump that includes an inlet end cap, an outlet end cap and a case coaxially joining the end caps to form a closed pump housing. An electric motor is disposed with the housing, and includes an armature journalled for rotation between the end caps, a stator surrounding the armature and means for applying electrical power to the motor. The armature is coupled to a gerotor mechanism for pumping fuel from the inlet to the outlet through the housing. The gerotor pumping mechanism comprises an annular wall on the inlet end cap forming an open pocket axially opposed to the armature. Inner and outer gear rotors are disposed within the pocket, and have radially opposed intermeshing teeth that define circumferentially disposed expanding and ensmalling pumping chambers. The inner gear rotor is coupled to the motor armature. Inlet and outlet gerotor ports in the inlet end cap axially open between the rotors into the expanding and ensmalling chambers, respectively. A bearing pad is affixed to the inlet end cap well adjacent to the outlet port, and extends radially inwardly through a gap that separates the end cap wall from the outer gear rotor to an arcuate bearing surface in sliding contacted with the gear rotor. Preferably, the inlet end cap, wall and bearing pad are of one-piece integral construction.

7 Claims, 2 Drawing Sheets

ELECTRIC-MOTOR FUEL PUMP

The present invention is directed to gerotor-type positive displacement fluid pumps, and more particularly to an electric-motor gerotor pump that finds particular utility in automotive fuel delivery systems and the like.

BACKGROUND AND OBJECTS OF THE INVENTION

U.S. Pat. No. 4,697,995 discloses an electric-motor gerotor-type fuel pump that comprises a pair of coaxially spaced end caps and a case that joins the end caps to form a closed pump housing. One of the end caps contains a fluid inlet for admitting fuel from a surrounding tank, and the opposing end cap contains an outlet for delivering fuel under pressure to an engine. An electric motor is disposed within the housing, and includes an armature rotatably journalled between the end caps and a stator that surrounds the armature. Electrical power is supplied to the armature through commutator brushes in the outlet end cap. A pair of intermeshing inner and outer gear rotors are positioned within the housing adjacent to the inlet end cap, and cooperate with inlet and outlet ports in the end cap for pumping fuel from the fuel inlet through the housing to the outlet, such that fuel within the housing is at substantially outlet pressure.

Although the gerotor-type fuel pump disclosed in the noted patent, assigned to the assignee hereof, has enjoyed substantial commercial acceptance and success, improvements remain desirable. One problem with the fuel pump disclosed in the noted patent lies in difficulty in aligning the inlet end cap and gerotor components during assembly of the pump. The outer gear rotor is surrounded in assembly by a cam ring having an annular bearing surface for sliding engagement with the outer gear rotor. The cam ring is affixed by screws to the opposing surface of the end cap. Slotted holes in the cam ring accommodate adjustment during assembly. However, even with assembly tooling, it remains difficult to mount the cam ring to the end cap so that the cam ring bearing surface is coaxial with the outer gear rotor. Furthermore, requirement for provision of outlet fuel passages and the like in the cam ring add to cost and complexity of manufacture.

Another problem with existing fuel pump constructions lies in generation of pressure pulsations during operation of the pumping mechanism. These pressure pulsations not only cause audible noise that is annoying to occupants of the associated vehicle, but also make attempts at automatic fuel control more difficult to implement. A number of attempts have been made to reduce pressure pulsations in the pump outlet fuel line, such as by tailoring design of the pump outlet check valve.

It is therefore a general object of the present invention to provide a gerotor-type pump that finds particular utility in automotive fuel delivery systems and like applications, that is less expensive to manufacture and assembly than are pumps of similar type heretofore proposed, and that obtains reduced pressure pulsations in the pump output as compared with prior-art pumps of a similar character without deleteriously affecting pump delivery.

SUMMARY OF THE INVENTION

In accordance with a first important aspect of the present invention, it has been recognized that it is not necessary to provide a bearing surface entirely surrounding the outer rotor of the gerotor pumping mechanism. Specifically, in gerotor-type pumps of the subject character having intermeshing teeth that define circumferentially disposed expanding and ensmalling pumping chambers, with fluid inlet and outlet ports axially opening between the rotors into the expanding and ensmalling chambers respectively, fluid pressure in the ensmalling chambers adjacent to the outlet port inherently urges the outer gear rotor radially outwardly only in the vicinity of the outlet port. Thus, a bearing mechanism for journalled guidance of the outer gear rotor need only be provided adjacent to the outlet port. In a presently preferred embodiment of the invention, such a bearing mechanism takes the form of a ring affixed to the end cap surrounding and separated by a radial gap from the outer gear rotor, and a bearing pad that extends radially inwardly from the ring to an arcuate surface of finite circumferential dimension slidably engaged by the outer gear rotor. In a second embodiment of the invention, the bearing comprises a cam ring that entirely surrounds the outer gear rotor, and is pivotally mounted to the inlet end cap adjacent to the outlet port, being otherwise free floating with respect to the end cap. In a third embodiment, a roller bearing is mounted on the end cap rotatably to engage the outer periphery of the outer gear rotor adjacent to the outlet port.

In addition to reducing complexity and cost of gerotor pump assembly, all of these embodiments have the additional advantage cf reducing vapor leakage between pumping chambers at high temperature, and thereby improving pump operating characteristics. That is, high fluid pressure in the ensmalling pump chambers near fluid outlet closes the gaps between the gear teeth at the low pressure inlet side of the pumping mechanism. Thus, the inner and outer gear rotor teeth remain in contact around the rotors, in contrast to prior art pumps in which the teeth lose contact in the region of transition between the low and high pressure sides of the pump. In this way, vapor leakage between the pumping chambers is reduced. Furthermore, it has been found that, by permitting the outer gear rotor more freely to flow at with respect to the inner gear rotor, tolerance variations among the gear components are more readily accommodated, and amplitude of pressure pulsations is reduced about 50% as compared with prior-art pump constructions of the type discussed above. Although not fully understood, it is believed that such reduced pressure pulsations result at least in part from the fact that the floating ring gear follows and accommodates radial runout in the inner and outer gears more readily than when the outer gear rotor is radially circumscribed as in the prior art.

An electric motor fuel pump in accordance with a presently preferred embodiment of the invention includes an inlet end cap, an outlet end cap and a case coaxially joining the end caps to form a closed pump housing. An electric motor is disposed within the housing, and includes an armature journalled for rotation between the end caps, a stator surrounding the armature and means for applying electrical power to the motor. The armature is coupled to a gerotor mechanism for pumping fuel from the inlet to the outlet through the housing. The gerotor pumping mechanism comprises an annular wall on the inlet end cap forming an open pocket axially opposed to the armature. Inner and outer gear rotors are disposed within the pocket, and have radially opposed intermeshing teeth that define circumferentially disposed expanding and ensmalling pumping chambers. The inner gear rotor is coupled to the motor armature. Inlet and outlet gerotor ports in the end cap axially open between the rotors into the expanding and ensmalling chambers respectively. A bearing pad is affixed to the inlet end cap wall adjacent to the outlet port, and extends radially inwardly through a gap that separates the end cap wall from the outer gear rotor to an arcuate bearing surface in sliding contacted with the gear rotor.

In the preferred embodiment of the invention so described, the inlet end cap, the wall affixed to the end cap that surrounds the outer gear rotor, and the bearing pad that extends radially inwardly from the wall to journal the outer gear rotor, are of one-piece integral construction. The outlet port from the gerotor pumping mechanism comprises an arcuate pocket in the inlet end cap axially opposed to the gear rotors and extending from the ensmalling chambers between the gear rotors radially outwardly to the gap between the wall and the outer gear rotor. Thus, the gap serves the dual functions of separating the outer gear rotor from the end cap to permit relative freedom of motion of the outer gear rotor, and as a fluid passage between the pumping mechanism and the internal cavity of the pump housing. Such provision of a relatively large arcuate fuel passage between the pumping chambers and the pump housing cavity is believed to help reduce pressure pulsations, as compared with prior art devices having a relatively restricted passage from the outlet port of the pumping mechanism to the cavity of the pump housing.

In accordance with a second important aspect of the present invention, in a unitary positive-displacement electric-motor gerotor-type fuel pump of the character previously described, the gerotor pumping mechanism is captured between the inlet cap and a port plate press fitted over pins that project axially from the cap. The port plate includes a second outlet port that aligns in assembly with the outlet port pocket in the end cap, so as to reduce axial pressure differential across the gear rotors, and thereby reduce friction between the gear rotors and the port plate.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
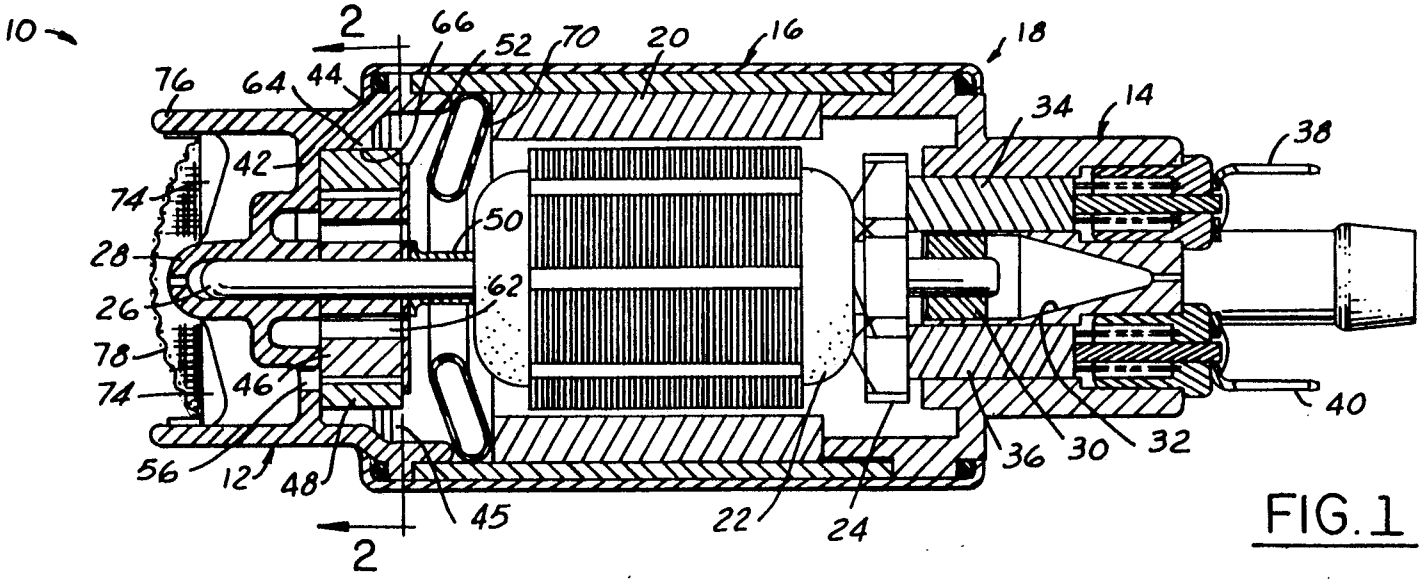
FIG. 1 is a longitudinal bisection of a self-contained electric-motor fuel pump in accordance with a presently preferred embodiment of the invention.
Figure 3:
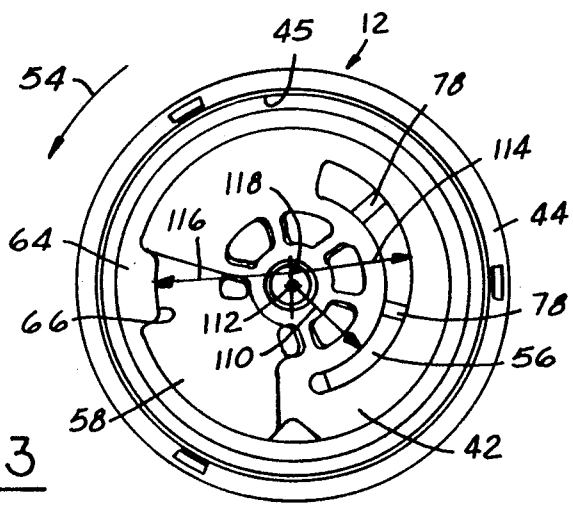
FIG. 3 is an end elevational view that illustrates the inlet end cap of the pump in FIG. 1.
Figure 2:
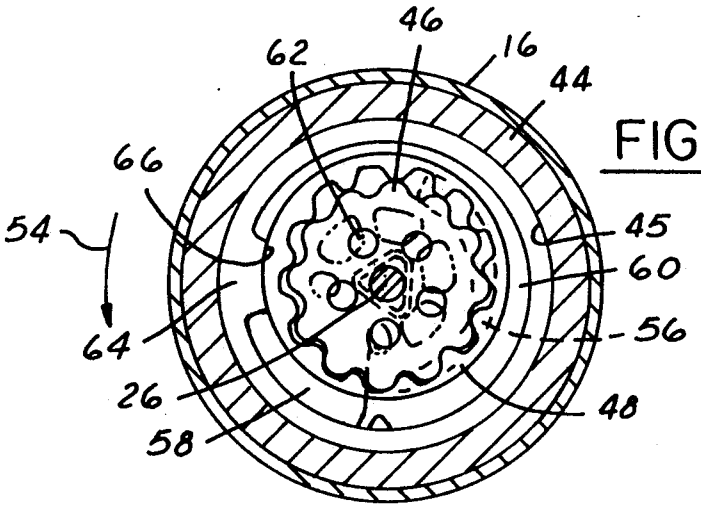
FIG. 2 is a sectional view taken substantially along the line 2—2 in FIG. 1.

FIGS. 1-3 illustrate an electric-motor fuel pump 10 in accordance with a presently preferred embodiment of the invention as comprising an inlet end cap 12 and an outlet end cap 14 coaxially spaced from each other by a shell or case 16 to form a unitary hollow pump housing assembly 18. A permanent magnet stator 20 is carried within case 16 surrounding an armature 22, which has electrical windings connected to a commutator plate 24. Armature 22 is journalled between end caps 12, 14 by a shaft 26 for rotation within housing 18. Specifically, shaft 26 is rotatably received within a hollow boss 28 centered in inlet end cap 12. A bearing sleeve 30 is press fitted or otherwise secured to the opposing end of shaft 26, and is both rotatably and axially slidably received in a pocket 32 centered in outlet end cap 14. Accommodation of limited axial motion of armature 22 helps balance axial forces created by pressure fluctuation at intake 56. A pair of brushes 34, 36 are carried by outlet end cap 14 in sliding engagement with commutator plate 24, and are electrically connected on end cap 14 to a pair of terminals 38, 40 for applying electrical power to the commutator plate and armature 12.

Inlet end cap 12 is of generally cup-shaped construction, having a radial wall or base 42 with boss 28 centered therein, and an axial wall or ring 44 to which case 16 is externally affixed. Walls 42, 44 thus form a pocket 45 axially aligned with and opposed to armature 22. A pair of inner and outer gear rotors 46, 48 are positioned within this end cap pocket. Inner gear rotor 46 is press fitted or otherwise rotatably coupled to shaft 26, being spaced from armature 22 by an eyelet 50 and a rotary seal 52. Seal 52 is free to rotate with outer gear 48 to reduce friction therebetween. As best seen in FIG. 2, inner and outer gears 46, 48 have the usual radially opposed intermeshing teeth that define therebetween circumferentially disposed expanding and ensmalling pumping chambers (with respect to direction 54 of armature and gear rotation). An arcuate inlet port 56 extends axially through end cap wall 42 to admit fluid at inlet pressure to the expanding chambers between the gear rotors. A wedge-shaped pocket 58 is disposed in wall 42 in opposition to gear rotors 46, 48 to form an outlet port from the gear pumping mechanism. Pocket 58 extends radially outwardly from the radius of the ensmalling pumping chambers to the periphery of rotor 48. Outer gear rotor 48 is spaced and separated from end cap wall 44 by a radial gap 60 that substantially entirely surrounds the outer gear rotor. Pocket 58 opens radially outwardly into gap 60. Thus, fluid at outlet pressure is fed from pocket 58 through gap 60 to the open cavity within pump housing 18.

A bearing pad 64 is integral with end cap wall 44 and extends radially inwardly therefrom to an arcuate bearing surface 66 in sliding contact with the opposed circumferential peripheral surface of outer gear rotor 48. As best seen in FIGS. 2 and 3, surface 66 is of finite circumferential dimension, and has the same radius of curvature as the outer periphery of rotor 48. Pad 64 overlies a portion of pocket 58 radially outwardly of the chambers between gear rotors 46, 48 at which chamber fluid pressure is highest. Specifically, as best seen in FIG. 2 the leading edge of pad 64 (with respect to direction 54 of gear rotation) is axially aligned with the leading edge of the arcuate outer portion of pocket 58. Thus, as previously noted, fluid pressure holds outer gear rotor 48 against bearing surface 66 of pad 64, while the remainder of the outer gear rotor periphery is spaced by gap 62 from the surrounding wall 44. As also previously noted, relative freedom of the outer gear rotor to move with respect to the surrounding housing not only accommodates manufacturing tolerance variations among assembly components, but also helps reduce leakage between pumping chambers at the low-pressure inlet side. Moreover, both the number of assembly components and the complexity of assembly are greatly reduced. End cap 12, including walls 42, 44 and sleeve 76, is of one-piece integral molded plastic construction.

The angular dimension of pad 64 and surface 66 is not critical, although such dimensions should be minimized both to reduce sliding friction between the outer gear rotor and the pad bearing surface, and to enhance free floating of the outer ring gear within the end cap pocket. Likewise, angular or circumferential position of the pad is not critical, as long as the bearing pad is radially outwardly adjacent to the pumping chambers at which pressure is highest. It will be noted in FIG. 3 that the radius of curvature 110 of the inner edge of inlet port 56 is centered on the axis 112 of shaft 26 and inner gear rotor 46, whereas the radius 114 of the outer edge of inlet port 56 and radius 116 of bearing surface 66 are centered on the axis of rotation 118 of outer gear rotor 48. It should also be noted that, while provision of arcuate bearing surface 66 is preferred, such arcuate surface construction is not critical in accordance with the broadest aspects of the invention. For example, it has been found that bearing surface 66 may be initially of flat geometry tangential to axis 118, and with a minimum dimension 116 between axis 118 and the flat bearing surface. Initial operation of the pump wears a small arcuate depression in the initially flat bearing surface on the order of 0.002 to 0.003 inches in depth. Although this wearing-in of the bearing surface introduces a small degree of play in the assembly, such is improved as compared with the typical current production standard of ±0.005 inches. This phenomenon also demonstrates that pad 64 and bearing surface 66 may be of small angular dimension indeed. An elastomeric pressure pulse damper 70 of closed hollow torroidel construction containing air under pressure is positioned within case 16 between stator 20 and end cap 44. A filter screen 74 is press fitted into an axially outwardly projecting sleeve 76 integral with end cap 12 for filtering inlet fuel. A circumferential array of ribs 74 extend from sleeve 76 to boss 28 for strengthening the inlet end cap.

Figure 4:
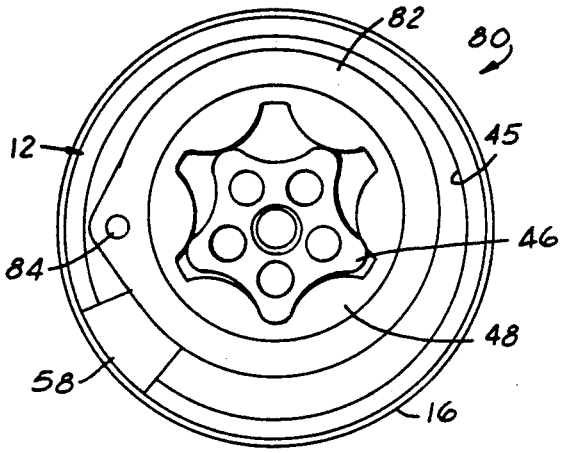
FIGS. 4 and 5 are sectional similar to that of FIG. 2 but illustrating respective modified embodiments of the invention.

FIG. 4 illustrates a modified pump 80 in which the outer gear rotor 48 is surrounded by a cam ring 82 that provides a radially inwardly directed bearing surface for sliding engagement with the outer gear rotor. Cam ring 82 is fastened to end cap 12 within end cap pocket 45 by a pivot pin 84 at a position adjacent to outlet port pocket 58. Thus, cam ring 82 is free to pivot about pin 84 in a radial plane lateral to the axis of rotation of the gear rotors.

Figure 5:
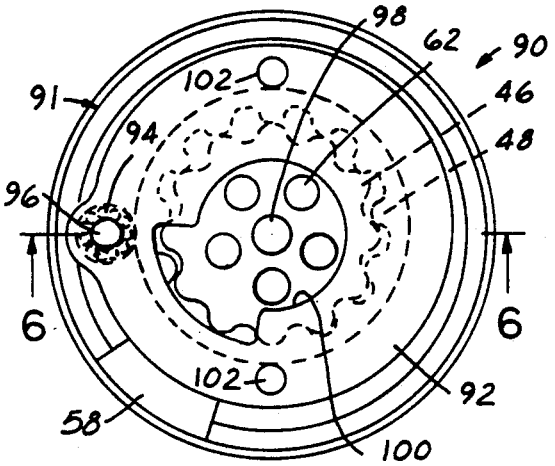
Figure 6:
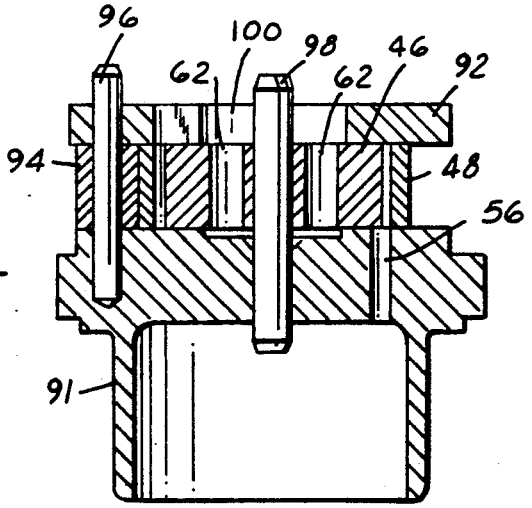
FIG. 6 is a fragmentary sectional view taken substantially long the line 6—6 in FIG. 5.

FIGS. 5 and 6 illustrate a second modified pump construction 90 in which inner and outer gear rotors 46, 48 are captured between end cap 91 and an opposing outlet port plate 92. A roller bearing 94 is mounted by a pin 96 between plate 92 and the opposing face of end cap 91 radially outwardly of the high-pressure pumping chambers for journalling rotation of the outer gear rotor. A guide pin 98 is affixed to end cap 91 and rotatably supports inner gear rotor 46. In this pump construction, the end cap and gear rotor assembly are provided as a subassembly, with the motor armature being coupled to inner gear 46 in assembly by prongs that extend into passages 62, as in above-noted U.S. Pat. No. 4,697,995. End cap 91 is similar to end cap 12 (FIGS. 1–3). An aperture 100 in plate 92 has an arcuate outer portion axially overlying the high pressure chambers between the gear rotors, and a circular inner portion overlying passages 62 surrounding pin 98. It will be noted that bearing 94 is positioned in radial alignment with the circumferentially leading edge of aperture 100. Pins 102 prevent motion of plate 92 with respect to end cap 91.

The embodiment of the invention illustrated in FIGS. 5 and 6 thus illustrates a second important aspect of the present invention whereby gear rotors 46, 48 are captured for rotation between inlet cap 91 and port plate 92, which is press fitted onto inlet cap 91 over pins 96, 102. Provision of axially opposed outlet ports 58, 100 in cap 91 and port plate 92 has the important advantage of reducing axial pressure differential across the gear rotors, and thereby reducing sliding friction and wear between outer gear rotor 48 and port plate 92. The embodiment of FIGS. 5 and 6 also have the advantage of greatly reducing cost of manufacture and assembly, as compared with corresponding prior art devices. Port plate 92 is of uniform thickness, and does not require expensive machining operations for maintaining close tolerances with the gear rotors. Port plate 92 may be press fitted over pins 96, 102 after applying a layer of grease to the opposing surface of the gear rotors 46, 48. Upon initial operation of the pump, the gasoline being pumped washes away the thin grease layer, leaving a small clearance, on the order of 0.0005 inches, to accommodate rotation of the gear rotors while minimizing leakage between the rotors and the port plate.

I claim:

1. A gerotor pump that comprises:

inner and outer gear rotors having intermeshing teeth that define circumferentially disposed expanding and ensmalling pumping chambers, means forming spaced fluid inlet and outlet ports axially opening between said rotors into said expanding and ensmalling chambers respectively, means coupled to said inner gear rotor for driving said rotors for positive displacement of fluid between said ports, and means guiding rotation of said outer gear rotor including means radially surrounding and spaced from said outer gear rotor forming a radial gap between said outer gear rotor and said surrounding means, and a bearing pad extending radially inwardly through said gap from said means radially surrounding said outer rotor and having an arcuate radially inwardly oriented surface in sliding contact with said outer gear rotor over a limited circumferential portion of said outer gear rotor, said gear rotor being free of contact with said means radially surrounding said outer gear rotor and spaced therefrom by said gap except at said arcuate surface.

2. The pump set forth in claim 1 wherein said arcuate surface having a radius of curvature equal to and concentric with radius of curvature of said outer gear rotor.

3. An electric motor fuel pump that comprises:

an inlet end cap having a fuel inlet, an outlet end cap having a fuel outlet and a case coaxially joining said end caps to form a pump housing, an electric motor including an armature journaled for rotation between said end caps within said housing, a stator surrounding said armature and means for applying electrical power to said motor, and means coupled to said armature for pumping fuel from said inlet to said outlet through said housing such that fuel within said housing is at substantially outlet pressure, said pumping means comprising:

an annular wall on said inlet end cap forming an open pocket axially opposed to said armature, inner and outer gear rotors disposed in said pocket, said inner and outer gear rotors having radially opposed intermeshing teeth that define circumferentially disposed expanding and ensmalling pumping chambers, said wall being spaced from said outer gear rotor by a radial gap, means on said inlet cap forming inlet and outlet ports axially opening between said rotor into said expanding and ensmalling chambers respectively, means coupling said armature to said inner gear rotor to drive said pump, and a bearing pad affixed to said wall and extending radially inwardly through said gap at a position radially adjacent to said outlet port on said inlet end cap, said bearing pad having an arcuate bearing surface in sliding contact with said outer gear rotor over a limited circumferential portion of said outer gear rotor, said gear rotor otherwise being free of contact with said wall and spaced by said gap from said wall except at said bearing surface.

4. The pump set forth in claim 3 wherein said inlet end cap, said wall and said bearing pad are of one-piece integral construction.

5. The pump set forth in claim 4 wherein said outlet port comprises an arcuate pocket in said inlet cap axially opposed to said gear rotors and extending radially from said ensmalling chambers to said gap adjacent to said pad.

6. The pump set forth in claim 5 further comprising pulse damping means of resilient toroidal construction positioned within said housing adjacent to said inlet cap and axially opposed to said gap.

7. The pump set forth in claim 6 wherein said damping means comprises a closed toroidal chamber having an elastomeric wall and containing air under pressure.

* * * * *